US006819289B2

(12) United States Patent
Kim et al.

(10) Patent No.: US 6,819,289 B2
(45) Date of Patent: Nov. 16, 2004

(54) CHIP ANTENNA WITH PARASITIC ELEMENTS

(75) Inventors: Hyun Hak Kim, Kyungki-do (KR); Jae Chan Lee, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/329,508

(22) Filed: Dec. 27, 2002

(65) Prior Publication Data

US 2003/0227411 A1 Dec. 11, 2003

(30) Foreign Application Priority Data

Jun. 5, 2002 (KR) ..... 2002-31578

(51) Int. Cl.[7] ..... H01Q 1/36; H01Q 1/38
(52) U.S. Cl. ..... 343/700 MS; 343/895
(58) Field of Search ..... 343/700 MS, 895, 343/702

(56) References Cited

U.S. PATENT DOCUMENTS 5,909,198 A 6/1999 Mandai et al. ..... 343/702
6,396,460 B2 * 5/2002 Tseng et al. ..... 343/895
6,512,493 B2 * 1/2003 Park et al. ..... 343/895
6,642,893 B1 * 11/2003 Hebron et al. ..... 343/702

* cited by examiner

*Primary Examiner*—James Vannucci
(74) *Attorney, Agent, or Firm*—Lowe Hauptman Gilman & Berner LLP

(57) ABSTRACT

A chip antenna, which is used for a mobile communication terminal, local area networks (LAN), or at blue tooth (BT) band, includes: a base block made of one selected from a diaelectric material and a magnetic material and including an upper surface, a lower surface, and four side surfaces disposed between the upper surface and the lower surface; inverted F-type first conductive patterns formed on a part of the base block; inverted L-type second conductive patterns formed on another part of the base block and connected in parallel with the first patterns; and parasitic elements spaced from the first and second patterns by a designated distance and forming an electromagnetic coupling with the first and second conductive patterns.

29 Claims, 9 Drawing Sheets the conventional art(FIG. 2)

the present invention(FIG. 3)

CHIP ANTENNA WITH PARASITIC ELEMENTS

BACKGROUND OF THE INVENTION

1. Field of the Invention

The present invention relates to a chip antenna which is used for a mobile communication terminal, local area networks (LAN), or at blue tooth (BT) band, and more particularly to a chip antenna with parasitic elements which forms an electromagnetic coupling with conductive patterns, thereby generating double or multiple resonances between the parasitic elements and the conductive patterns connected to a power-feeding terminal. Therefore, the chip antenna of the present invention is miniaturized, has a broad bandwidth, and removes a peak peripherally generated around usable frequency band by resonance of the chip antenna.

2. Description of the Related Art

Generally, a known mobile communication terminal comprises a main body, and a bar-type antenna extruding from the upper surface of the main body. The bar-type antenna of the mobile communication terminal serves to transmit and receive radio waves. Resonant frequency of the bar-type antenna of the mobile communication terminal is determined by the total length of a conductor of the antenna. However, since the bar-type antenna for mobile communication terminal extrudes from the main body, this type of the antenna does not satisfy the recent trend of the mobile communication terminal toward miniaturization.

A conventional chip antenna for overcoming this disadvantage is illustrated in FIG. 1. FIG. 1 is a see-through perspective view of this conventional chip antenna.

With reference to FIG. 1, the conventional chip antenna comprises a substrate 1, a conductor 2, and a power-feeding terminal 3. The substrate 1 is made of a dielectric material. The conductor 2 is helically disposed within the substrate 1 or on the substrate 1. The conductor 2 has two parallelly-arranged conductive patterns. The power-feeding terminal 3 is formed on the surface of the substrate 1 in order to apply a voltage to the conductor 2. One conductive pattern of the conductor 2 is connected to the other conductive pattern of the conductor 2 at a turning section 2*a*.

In the aforementioned conventional chip antenna, as the coiling number (L) of the conductor increases, the resonant frequency ($f_o$) is lowered. Further, the coiling number (L) of the conductor is inversely proportional to the bandwidth of the antenna. Therefore, the conductor of the conventional chip antenna is constructed so that two conductive patterns of the conductor 2 are parallelly arranged at the turning section 2*a*, thereby not increasing the coiling number (L) of the conductor and enlarging an opposite area between the conductor and the ground, thereby increasing the capacitance (C) generated between the conductor and the ground and broadening the bandwidth.

However, the broadened bandwidth of the aforementioned conventional chip antenna is not sufficient. Further, since the antenna characteristics are determined by the interval between two parallelly-arranged conductive patterns of the conductor, the reliability of the conventional chip antenna is deteriorated.

FIG. 2 is a see-though perspective view of another conventional chip antenna. With reference to FIG. 2, another conventional chip antenna comprises a base block 10, inverted F-type first conductive patterns 11, and inverted L-type second conductive patterns 12. The base block 10 is made of a dielectric or magnetic material. The base block 10 includes an upper surface, a lower surface opposite to the upper surface, and four side surfaces disposed between the upper surface and the lower surface. The inverted F-type first conductive patterns 11 are formed on a part of the base block 10. The inverted L-type second conductive patterns 12 are also formed on another part of the base block 10. The inverted F-type first conductive patterns 11 are connected in parallel with the inverted L-type second conductive patterns 12.

The conventional chip antenna of FIG. 2 has an advantage in that the chip antenna can be miniaturized without changing the antenna characteristics. Further, the resonant frequencies of respective conductive patterns are closed to each other, thereby broadening the bandwidth at a single frequency.

However, the antenna characteristics are deteriorated by structural and/or material factors due to the miniaturization of the aforementioned conventional chip antenna. Further, with only two independent conductive patterns, since it is difficult to generate double or multiple resonances, this conventional chip antenna is limited in broadening the bandwidth and improving the gain of the chip antenna.

SUMMARY OF THE INVENTION

Therefore, the present invention has been made in view of the above problems, and it is an object of the present invention to provide a chip antenna using parasitic elements for forming an electromagnetic coupling with conductor patterns, thereby generating double or multiple resonances between the parasitic elements and the conductor patterns connected to a power-feeding terminal.

It is another object of the present invention to provide a chip antenna with parasitic elements, which is miniaturized, has a broad bandwidth, and removes a peak peripherally generated around usable frequency band by resonance of the chip antenna.

In accordance with one aspect of the present invention, the above and other objects can be accomplished by the provision of a chip antenna including: a base block made of one selected from a dielectric material and a magnetic material and including an upper surface, a lower surface opposite to the upper surface, and four side surfaces disposed between the upper surface and the lower surface; inverted F-type first conductive patterns formed on a part of the base block; inverted L-type second conductive patterns formed on another part of the base block and connected in parallel with the first conductive patterns; and parasitic elements spaced from the first and second conductive patterns by a designated distance and forming an electromagnetic coupling with the first and second conductive patterns.

In accordance with a further aspect of the present invention, there is provided a chip antenna including: a rectangular parallelepiped base block made of one selected from a dielectric material and a magnetic material; first conductive patterns including side electrodes wound in a spiral form on a part of the base block, upper and lower electrodes connected to the side electrodes, and bending portions formed on the upper and lower electrodes; second conductive patterns disposed within the base block between the upper electrodes and the lower electrodes and connected in parallel with the first conductive patterns; a power-feeding terminal and a ground terminal, both connected to the first conductive patterns; an impedance-controlling electrode connected to the upper end of the base block between the second conductive patterns and the power-feeding terminal to control the impedance; and parasitic elements spaced from the first and second conductive patterns by a designated distance and forming an electromagnetic coupling with the first and second conductive patterns.

In accordance with another aspect of the present invention, there is provided a chip antenna including: a rectangular parallelepiped base block made of one selected from a dielectric material and a magnetic material; first conductive patterns including side electrodes wound in a spiral form on a part of the base block, upper and lower electrodes connected to the side electrodes, and bending portions formed on the upper and lower electrodes; second conductive patterns disposed within the base block between the upper electrodes and the lower electrodes and connected in parallel with the first conductive patterns; a power-feeding terminal and a ground terminal, both connected to the first conductive patterns; an impedance-controlling electrode connected to the upper end of the base block between the second conductive patterns and the power-feeding terminal to control the impedance; an insulating layer formed on the upper surface of the base block; and a parasitic pattern layer including parasitic patterns formed on the insulating layer.

In accordance with yet another aspect of the present invention, there is provided a chip antenna including: a base block made of one selected from a dielectric material and a magnetic material and having a multilayered construction by stacking a plurality of sheet layers; first conductive patterns including side electrodes wound in a spiral form on a part of the base block, upper and lower electrodes connected to the side electrodes, and bending portions formed on the upper and lower electrodes; second conductive patterns disposed within the base block between the upper electrodes and the lower electrodes and connected in parallel with the first conductive patterns; a power-feeding terminal and a ground terminal, both connected to the first conductive patterns; an impedance-controlling electrode connected to the upper end of the base block between the second conductive patterns and the power-feeding terminal to control the impedance; and parasitic patterns formed on at least one sheet layer disposed between the sheet layer provided with the lower electrodes of the first conductive patterns and the sheet layer provided with the upper electrodes of the first conductive patterns, thereby forming an electromagnetic coupling with the first and second conductive patterns.

Those skilled in the art will appreciate that at least two of individual chip antennas in accordance with the aforementioned aspects of the present invention can be combined as a single chip antenna.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, preferred embodiments of the present invention will be described in detail with reference to the accompanying drawings.

Figure 3:
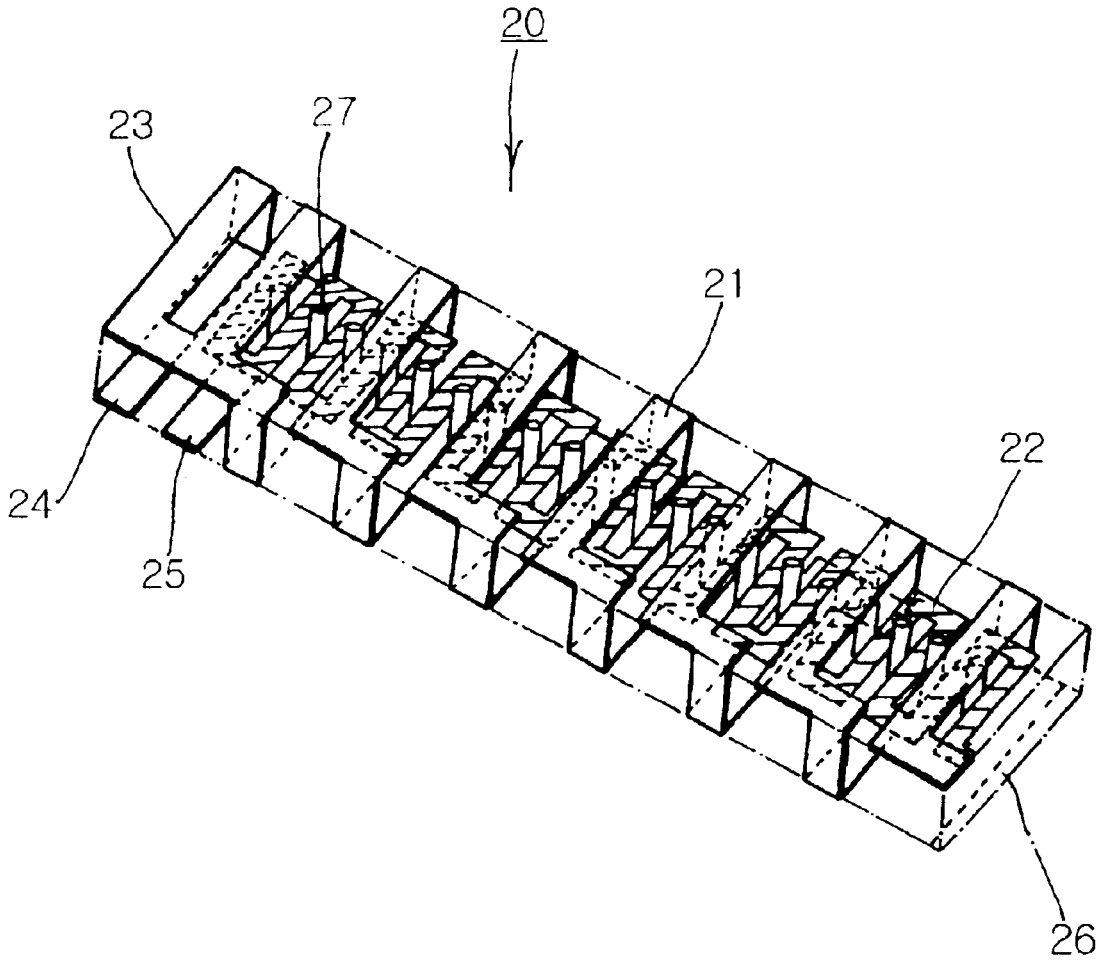
FIG. 3 is a see-through perspective view of a chip antenna in accordance with a first embodiment of the present invention.

FIG. 3 is a see-through perspective view of a chip antenna in accordance with a first embodiment of the present invention. With reference to FIG. 3, the chip antenna 20 in accordance with the first embodiment of the present invention includes a rectangular parallelepiped base block, first conductive patterns 21, second conductive patterns 22, a power-feeding terminal 24, a ground terminal 25, an impedance-controlling electrode 23, and parasitic elements 27. The base block is made of a dielectric or magnetic material. The first conductive patterns 21 include side electrodes 21*b* wound in a spiral form on a part of the base block, upper electrodes 21*a*, lower electrodes 21*c*, and bending portions formed on the upper and lower electrodes 21*a* and 21*c*. Herein, the upper electrodes 21*a* and the lower electrodes 21*c* are connected to the side electrodes 21*b*. The second conductive patterns 22 are disposed within the base block between the upper electrodes 21*a* and the lower electrodes 21*c* of the first conductive patterns 21, and are connected in parallel with the first conductive patterns 21. The power-feeding terminal 24 and the ground terminal 25 are connected to the first conductive patterns 21. The impedance-controlling electrode 23 is connected to the upper end of the base block between the second conductive patterns 22 and the power-feeding terminal 24, and serves to control the impedance. The parasitic elements 27 are spaced from the first and second conductive patterns 21 and 22 by a designated distance, and form an electromagnetic coupling with the first and second conductive patterns 21 and 22.

Herein, the reference number 26 denotes a fixed terminal.

Preferably, as described above, the base block is substantially formed as a rectangular parallelepiped. However, the base block may be formed in any shape being suitable to be mounted on a substrate.

The first conductive patterns 21 are formed of a repeated unit pattern. Preferably, this repeated pattern is in a spiral line formed by connecting the upper electrodes 21*a*, the lower electrodes 21*c*, and the side electrodes 21*b*. Further, preferably, the bending portions of the first conductive patterns 21 are substantially bent at a right angle. The side electrodes 21*b* of the first conductive patterns 21 are perpendicular to the upper and lower surfaces of the base block. The upper and lower electrodes 21*a* and 21*c* of the first conductive patterns 21 are formed in the shape of a letter L so as to be connected to the side electrodes 21*b*.

Figure 4:
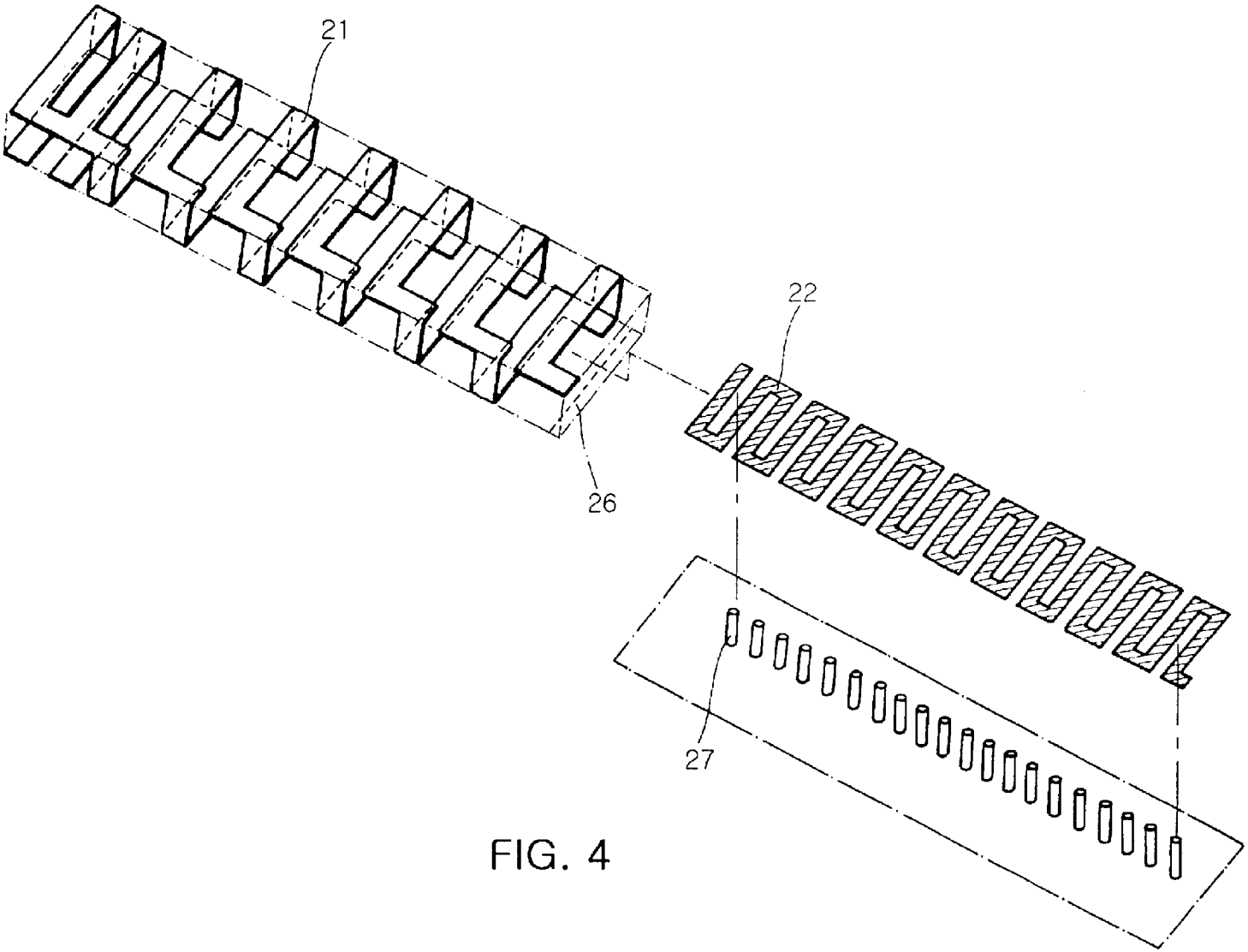
FIG. 4 is an exploded perspective view of the chip antenna of FIG. 3.
Figure 5A:
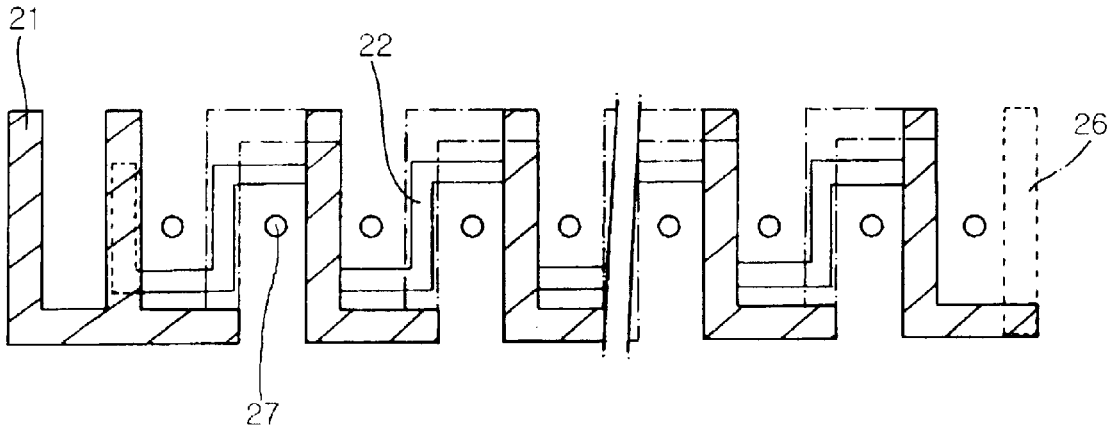
FIGS. 5*a* and 5*b* are a plan view and a front view of the chip antenna of FIG. 3, respectively.
Figure 5B:
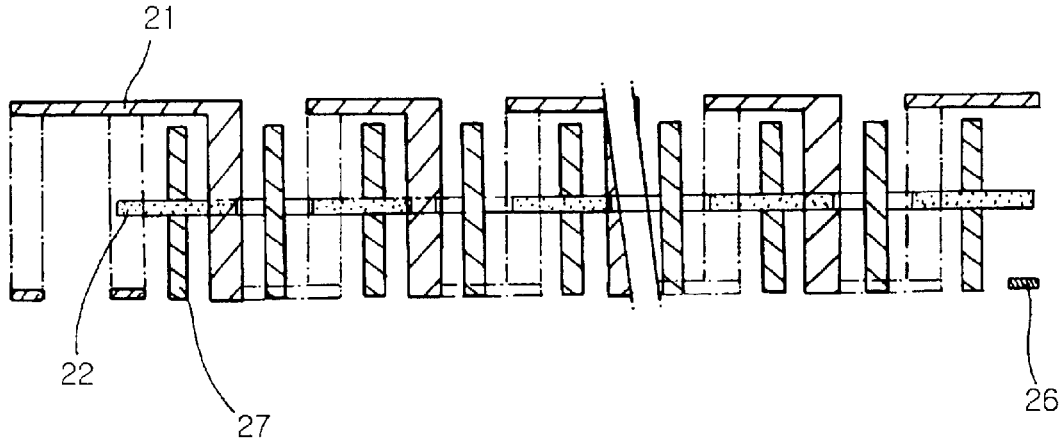

FIG. 4 is an exploded perspective view of the chip antenna of FIG. 3, and FIGS. 5*a* and 5*b* are a plan view and a front view of the chip antenna of FIG. 3, respectively.

With reference to FIG. 4 and FIGS. 5*a* and 5*b*, the parasitic elements 27 are formed in a vertical pillar such as a cylinder or a square pillar, and at least one parasitic element 27 is provided on the upper electrodes 21*a* of the first conductive patterns 21. Preferably, as shown in FIGS. 5*a* and 5*b*, one parasitic element 27 is provided between the neighboring electrodes of the upper electrodes 21*a*. More preferably, at least one parasitic element 27 may be provided between the neighboring electrodes of the upper electrodes 21*a*. The parasitic elements 27 are electromagnetically coupled with the first and second conductive patterns 21 and 22, thereby generating duplex or multiple resonances and substantially broadening the bandwidth.

The second conductive patterns 22 are preferably shaped in a spiral structure such as a perpendicularly meandering-line or a helical line. However, the second conductive patterns 22 may be shaped in a linear structure or constructed as a flat plate. The first conductive patterns 21 may be wound in a spiral form on the outer surface of the base block. Otherwise, either the upper electrodes 21*a* or the lower electrodes 21*b* may be disposed within the base block. That is, the second conductive patterns 22 may be disposed within the spirally wound first conductive patterns 21, or the second conductive patterns 22 may be disposed outside the first conductive patterns 21.

Preferably, the power-feeding terminal 24 and the ground terminal 25, which extend from one end of the first conductive patterns 21, may be connected in parallel with each other. The power-feeding terminal 24 and the ground terminal 25 may be formed on one side surface of the base block.

The power-feeding terminal 24 may be extended from one end of the first conductive patterns 21 toward the upper, lower, and side surfaces of the base block so as to be wound on a part of the base block. Also, the ground terminal 25 may be extended from one end of the first conductive patterns 21 toward the upper, lower, and side surfaces of the base block so as to be wound on a part of the base block. Otherwise, the ground terminal 25 may be adjacent to the end of the base block or the power-feeding terminal 24 may be disposed between the first conductive patterns 21 and the ground terminal 25.

The impedance-controlling electrode 23 may be connected to the base block between the first conductive patterns 21 and the ground terminal 25, and serve to control the impedance.

The base block, the first and second conductive patterns, the power-feeding terminal, the ground terminal, and the impedance-controlling electrode of this embodiment are substantially the same as those of other embodiments of the present invention, and a detailed description thereof will thus be omitted.

Figure 6:
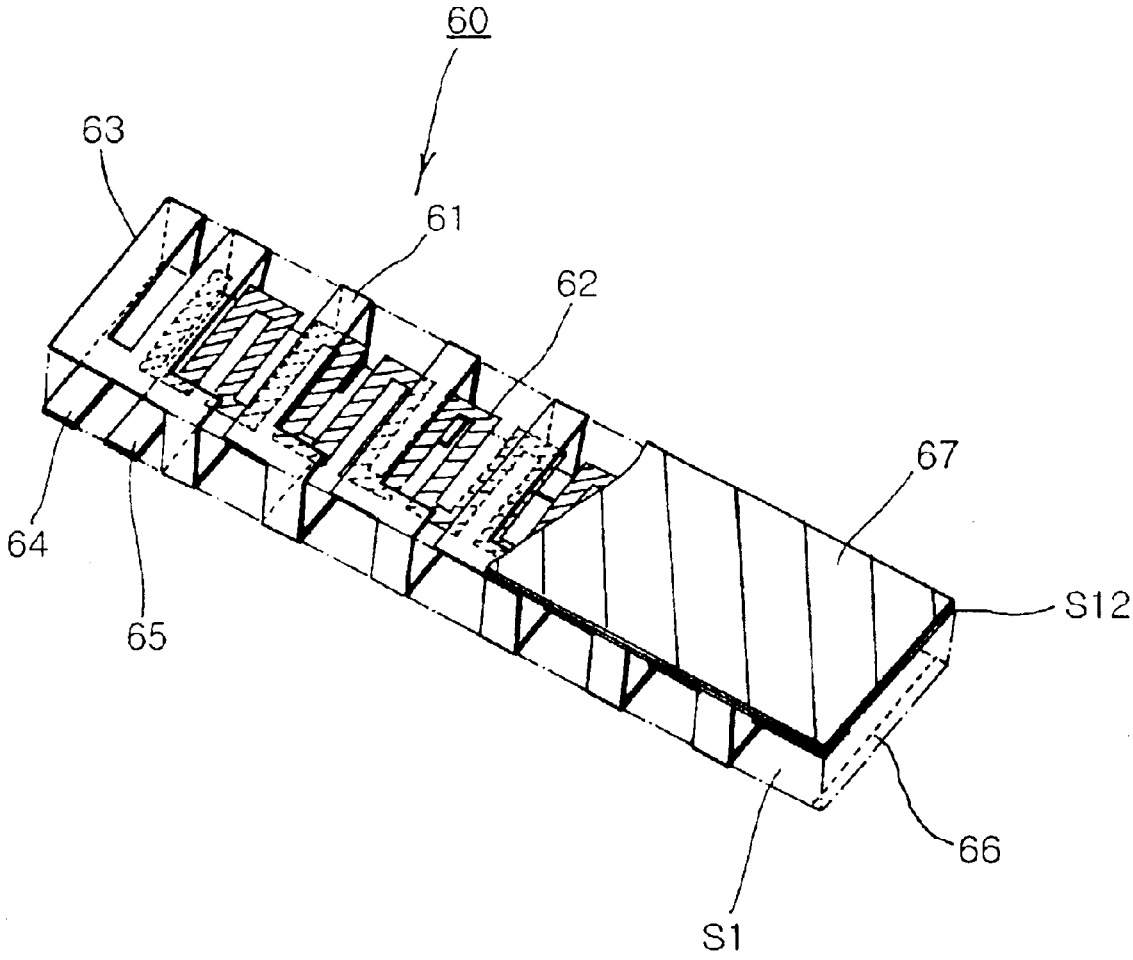
FIG. 6 is a see-through perspective view of a chip antenna in accordance with a second embodiment of the present invention.
Figure 7:
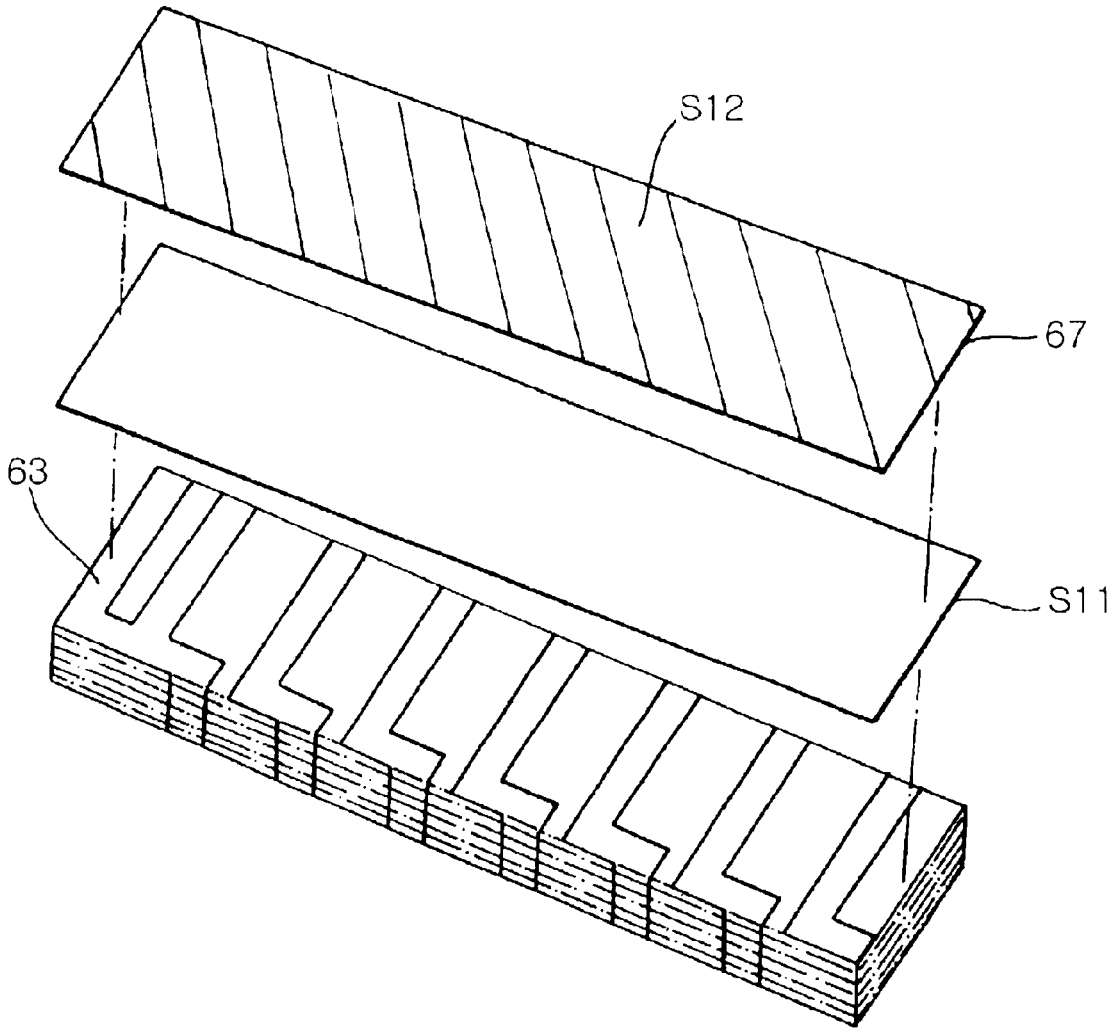
FIG. 7 is an exploded view of the chip antenna of FIG. 6.

FIG. 6 is a see-through perspective view of a chip antenna in accordance with a second embodiment of the present invention, and FIG. 7 is an exploded view of the chip antenna of FIG. 6.

Figure 8:
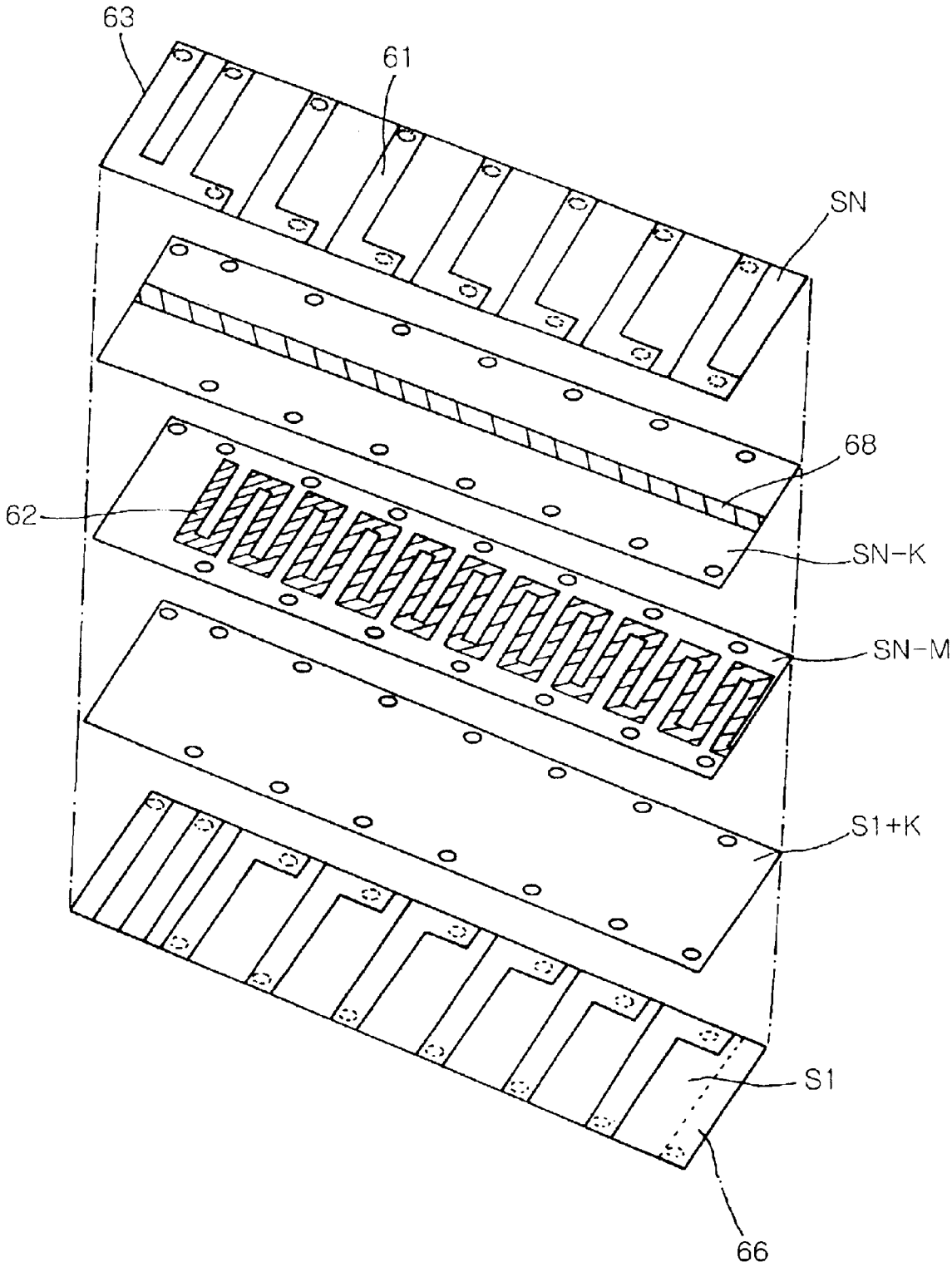
FIG. 8 is an exploded perspective view of a chip antenna in accordance with a third embodiment of the present invention.

With reference to FIGS. 7 and 8, the chip antenna 60 in accordance with the second embodiment of the present invention includes a rectangular parallelepiped base block, first conductive patterns 61, second conductive patterns 62, a power-feeding terminal 64, a ground terminal 65, an impedance-controlling electrode 63, an insulating layer S11, and a parasitic pattern layer S12. The base block is made of a dielectric or magnetic material. The first conductive patterns 61 include side electrodes 61*b* wound in a spiral form on a part of the base block, upper electrodes 61*a*, lower electrodes 61*c*, and bending portions formed on the upper and lower surfaces 61*a* and 61*c*. Herein, the upper electrodes 61*a* and the lower electrodes 61*c* are connected to the side electrodes 61*b*. The second conductive patterns 62 are disposed within the base block between the upper electrodes 61*a* and the lower electrodes 61*c* of the first conductive patterns 61, and are connected in parallel with the first conductive patterns 61. The power-feeding terminal 64 and the ground terminal 65 are connected to the first conductive patterns 61. The impedance-controlling electrode 63 is connected to the upper end of the base block between the second conductive patterns 62 and the power-feeding terminal 64, and serves to control the impedance. The insulating layer S11 is formed on the upper surface of the base block. The parasitic pattern layer S12 includes parasitic patterns 67 formed on the insulating layer S11.

Herein, the reference number 66 denotes a fixed terminal.

The parasitic patterns 67 may be formed entirely or selectively on the parasitic pattern layer S12. These parasitic patterns 67 form an electromagnetic coupling with the first and second conductive patterns 61 and 62, thereby generating double or multiple resonances. Therefore, a resonant area due to the generated double or multiple resonances is enlarged, thereby broadening the bandwidth, compared to the conventional chip antenna without the parasitic element.

FIG. 8 is an exploded perspective view of a chip antenna in accordance with a third embodiment of the present invention.

With reference to FIG. 8, the chip antenna in accordance with the third embodiment of the present invention includes a rectangular parallelepiped base block, first conductive patterns 61, second conductive patterns 62, a power-feeding terminal, a ground terminal, an impedance-controlling electrode 63, and parasitic patterns 68. The base block is made of a dielectric or magnetic material and multilayered by stacking a plurality of sheet layers. The first conductive patterns 61 include side electrodes wound in a spiral form on a part of the base block, upper electrodes, lower electrodes, and bending portions formed on the upper and lower surfaces to the side surfaces. Herein, the upper electrodes and the lower electrodes are connected to the side electrodes. The second conductive patterns 62 are disposed within the base block between the upper electrodes and the lower electrodes of the first conductive patterns 61, and are connected in parallel with the first conductive patterns 61. The power-feeding terminal and the ground terminal are connected to the first conductive patterns 61. The impedance-controlling electrode 63 is connected to the upper end of the base block between the second conductive patterns 62 and the power-feeding terminal, and serves to control the impedance. The parasitic patterns 68 are formed on at least one sheet layer disposed between the sheet layer S1 provided with the lower electrodes of the first conductive patterns 61 and the sheet layer SN provided with the upper electrodes of the first conductive patterns 61. The parasitic patterns 68 form an electromagnetic coupling with the first and second conductive patterns 61 and 62.

The base block of the present invention is multilayered in such a way that rectangular sheet layers S1 to SN are stacked. The upper electrodes of the first conductive patterns 61 are formed on the surface of the uppermost sheet layer, and the lower electrodes of the first conductive patterns 61 are formed on the surface of the lowermost sheet layer. The upper electrodes of the first conductive patterns 61 are electrically connected to the lower electrodes of the first conductive patterns 61 by the side electrodes formed on the side surfaces of the base block by stacking these sheet layers S1 to SN or, by side surfaces formed within via holes formed on intermediate sheet layers. This multilayered base block may be also applied to other embodiments of the present invention.

As shown in FIG. 8, the parasitic patterns 68 in accordance with the third embodiment of the present invention may be formed on at least one sheet layer disposed between the sheet layer SN provided with the upper electrodes of the first conductive patterns 61 and the sheet layer SN-M provided with the second conductive patterns 62. Alternatively, the parasitic patterns 68 in accordance with the third embodiment of the present invention may be formed on at least one sheet layer disposed between the sheet layer S1 provided with the lower electrodes of the first conductive patterns 61 and the sheet layer SN-M provided with the second conductive patterns 62. Moreover, the parasitic patterns 68 in accordance with the third embodiment of the present invention may be formed on both at least one sheet layer disposed between the sheet layer SN provided with the upper electrodes of the first conductive patterns 61 and the sheet layer SN-M provided with the second conductive patterns 62 and at least one sheet layer disposed between the sheet layer S1 provided with the lower electrodes of the first conductive patterns 61 and the sheet layer SN-M provided with the second conductive patterns 62.

The parasitic patterns 68 may be formed on a part of the aforementioned sheet layer. The parasitic patterns 68 are not limited in their configuration and shape. As described in the above second embodiment of the present invention, the parasitic patterns 68 form an electromagnetic coupling with the first and second conductive patterns 61 and 62, thereby generating double or multiple resonances. Therefore, a resonant area due to the generated double or multiple resonances is enlarged, thereby broadening the bandwidth, compared to the conventional chip antenna without the parasitic element.

Figure 2:
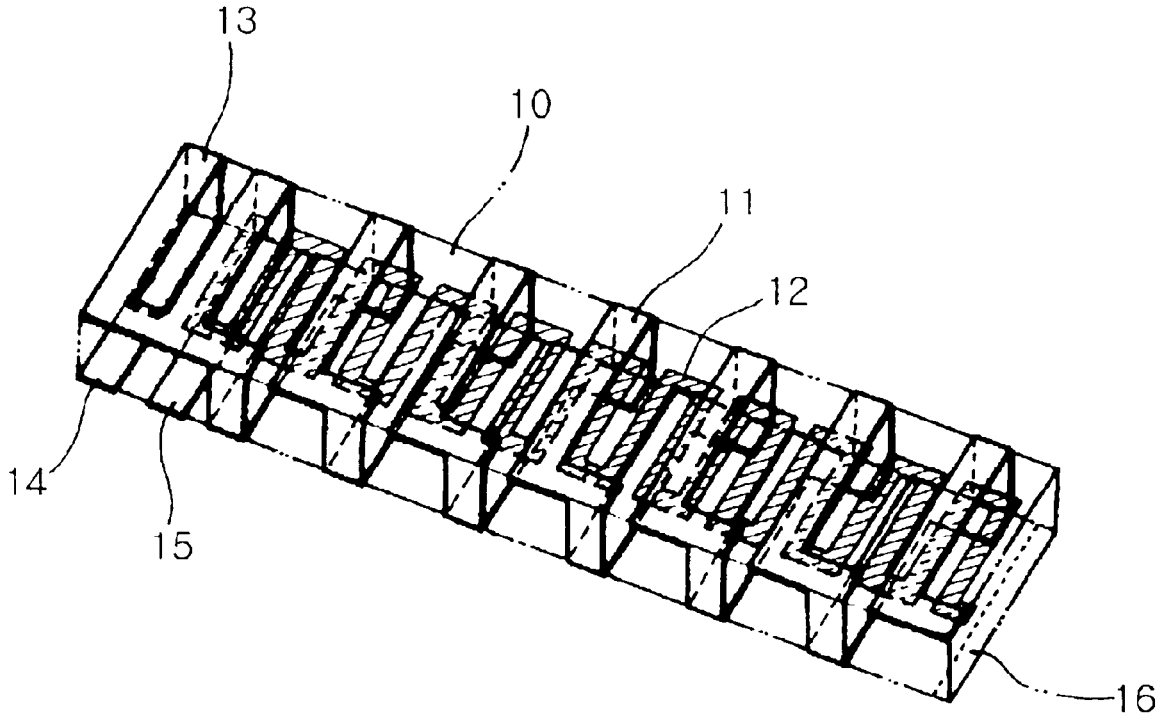
PRIOR ART FIG. 2
FIG. 2 is a see-though perspective view of another conventional chip antenna.
Figure 9A:
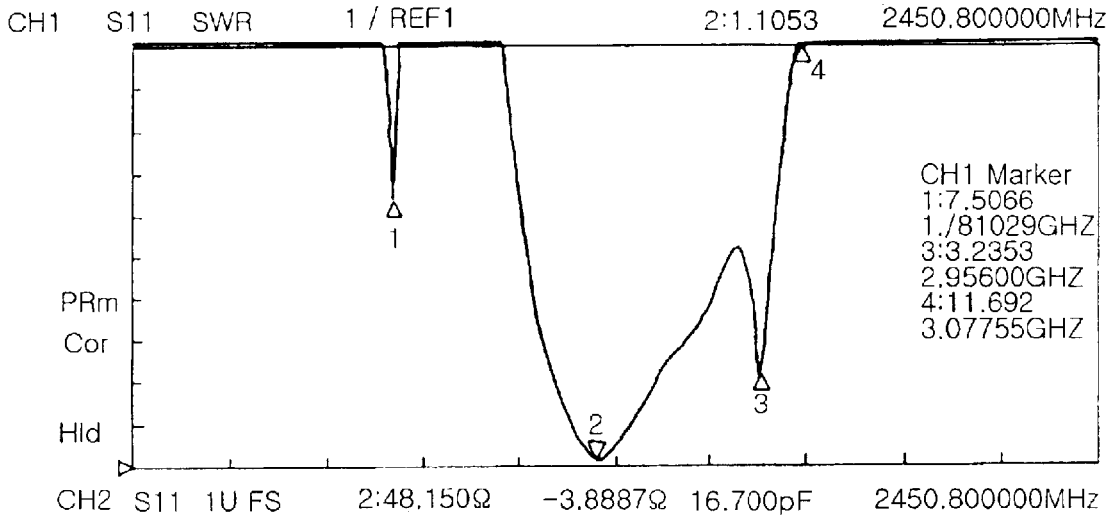
PRIOR ART FIG.9a
FIGS. 9*a* and 9*b* are graphs showing VSWR (Voltage Standing Wave Ratio) of the chip antenna of the first embodiment of the present invention and the conventional chip antenna of FIG. 2, respectively.
Figure 9B:
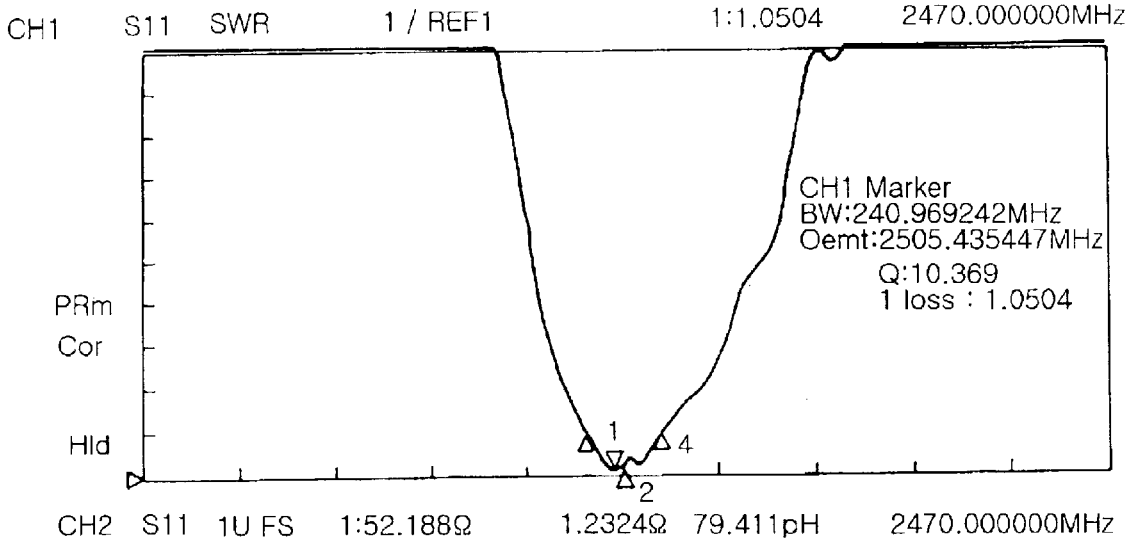

FIG. 9*a* is a graph showing the VSWR (Voltage Standing Wave Ratio) of the chip antenna of the first embodiment of the present invention, and FIG. 9*b* is a graph showing the VSWR (Voltage Standing Wave Ratio) of the conventional chip antenna of FIG. 2. The graphs shown in FIGS. 9*a* and 9*b* are VSWR graphs at 1.0 GHz~4.0 GHz. As shown in FIG. 9*b*, in the conventional chip antenna, the peak, i.e., parasitic oscillation, is generated by resonance of the conventional chip antenna. On the other hand, as shown in FIG. 9*a*, the peak generated by the resonance of the chip antenna of the present invention is offset by the electromagnetic coupling between the power-feeding element and the parasitic element, i.e., by interaction with electromagnetic field.

Figure 1:
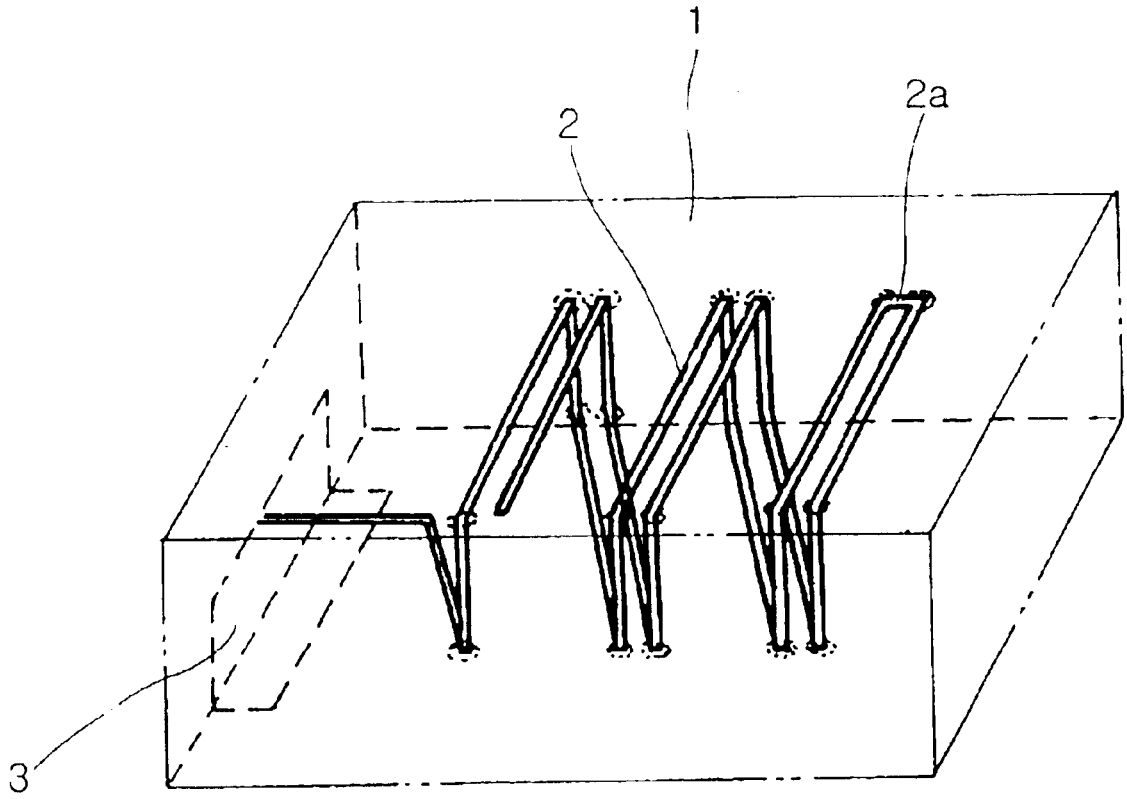
PRIOR ART FIG. 1
FIG. 1 is a see-through perspective view of a conventional chip antenna.

As described above, as shown in FIG. 1, since the power-feeding elements of one conventional chip antenna are disposed in parallel, individual electromagnetic routes are the same. Therefore, with the conventional chip antenna of FIG. 1, it is difficult to generate double or multiple resonances in order to broaden the bandwidth. Further, in another conventional chip antenna of FIG. 2, the antenna characteristics are deteriorated by structural and/or material factors due to the miniaturization of the aforementioned conventional chip antenna. Further, with only two independent conductive patterns, since it is difficult to generate double or multiple resonances, this conventional chip antenna is limited in broadening the bandwidth and improving the gain of the chip antenna.

The chip antenna in accordance to the preferred embodiments of the present invention employs parasitic elements for forming an electromagnetic coupling with conductor patterns, thereby generating double or multiple resonances between the parasitic elements and the conductor patterns connected to a power-feeding terminal and broadening the bandwidth. Further, the bandwidth can be broadened without changing impedance according to the power-feeding structure and the size of the chip antenna. The electromagnetic coupling is formed between the parasitic elements and the conductive radiation elements patterns by controlling the size of the parasitic elements and the interval between the parasitic elements, thereby generating double or multiple resonances and broadening the bandwidth. Further, the parasitic oscillation with low radiant efficiency generated peripherally around usable frequency band is offset by a proper electromagnetic coupling between the parasitic element and the conductive radiation element, thereby avoiding operational errors that can occur in mounting the chip antenna on a main body of the mobile communication terminal.

As apparent from the above description, the present invention provides a chip antenna with parasitic elements which forms an electromagnetic coupling with conductive patterns, thereby generating double or multiple resonances between the parasitic elements and the conductive patterns connected to a power-feeding terminal. Therefore, the chip antenna of the present invention is miniaturized, has a broad bandwidth, and removes a peak peripherally generated around usable frequency band by the resonance of the chip antenna.

Further, the usable frequency bandwidth is broadened by employing the parasitic elements. The parasitic oscillation with low radiant efficiency generated peripherally around the usable frequency band is removed, thereby avoiding a risk of operational errors that can occur in mounting the chip antenna on a main body of the mobile communication terminal.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A chip antenna comprising:

a base block made of one selected from a dielectric material and a magnetic material and including an upper surface, a lower surface opposite to the upper surface, and four side surfaces disposed between the upper surface and the lower surface;

inverted F-type first conductive patterns formed on a part of the base block;

inverted L-type second conductive patterns formed on another part of the base block and connected in parallel with the first conductive patterns; and parasitic elements spaced from the first and second conductive patterns by a designated distance and forming an electromagnetic coupling with the first and second conductive patterns.

2. The chip antenna as set forth in claim 1, wherein the base block is a rectangular parallelepiped.

3. The chip antenna as set forth in claim 1, wherein the first conductive patterns comprises:

conductive patterns extending in a length direction of the base block;

a power-feeding terminal formed on one end of the conductive patterns; and a ground terminal formed adjacent to the power-feeding terminal.

4. The chip antenna as set forth in claim 3, wherein the second conductive patterns are connected to a part of the power-feeding terminal of the first conductive patterns and extend in the length direction of the base block.

5. The chip antenna as set forth in claim 1, wherein the parasitic elements are formed in the shape of a vertical pillar.

6. A chip antenna comprising:

a rectangular parallelepiped base block made of one selected from a dielectric material and a magnetic material;

first conductive patterns including side electrodes wound in a spiral form on a part of the base block, upper and lower electrodes connected to the side electrodes, and bending portions formed on the upper and lower electrodes;

second conductive patterns disposed within the base block between the upper electrodes and the lower electrodes and connected in parallel with the first conductive patterns;

a power-feeding terminal and a ground terminal, both connected to the first conductive patterns;

an impedance-controlling electrode connected to the upper end of the base block between the second conductive patterns and the power-feeding terminal to control the impedance; and parasitic elements spaced from the first and second conductive patterns by a designated distance and forming an electromagnetic coupling with the first and second conductive patterns.

7. The chip antenna as set forth in claim 6, wherein the bending portions of the first conductive patterns are substantially bent at a right angle.

8. The chip antenna as set forth in claim 6, wherein the side electrodes of the first conductive patterns are perpendicular to the upper and lower surfaces the base block.

9. The chip antenna as set forth in claim 6, wherein the upper and lower electrodes of the first conductive patterns are formed in the shape of a letter L so as to be connected to the side electrodes.

10. The chip antenna as set forth in claim 9, wherein the parasitic elements are formed in the shape of a vertical pillar.

11. The chip antenna as set forth in claim 10, wherein at least one parasitic element is provided on the upper electrodes of the first conductive patterns.

12. The chip antenna as set forth in claim 10, wherein one parasitic element is provided between the neighboring electrodes of the upper electrodes of the first conductive patterns.

13. The chip antenna as set forth in claim 10, wherein at least one parasitic element is provided between the neighboring electrodes of the upper electrodes of the first conductive patterns.

14. The chip antenna as set forth in claim 6, wherein the second conductive patterns within the base block are shaped in a perpendicularly meandering line or a helical line.

15. The chip antenna as set forth in claim 14, wherein the parasitic elements are formed in the shaped of a vertical pillar.

16. The chip antenna as set forth in claim 15, wherein at least one parasitic element is provided between the neighboring patterns of the second conductive patterns.

17. The chip antenna as set forth in claim 15, wherein one parasitic element is provided between the neighboring patterns of the second conductive patterns.

18. The chip antenna as set forth in claim 6, wherein first conductive patterns are wound in a spiral form on the outer surface of the base block.

19. The chip antenna as set forth in claim 6, wherein either the upper electrodes or the lower electrodes of the first conductive patterns are disposed within the base block.

20. The chip antenna as set forth in claim 6, wherein the second conductive patterns are disposed within the spirally wound first conductive patterns.

21. The chip antenna as set forth in claim 6, wherein the second conductive patterns are disposed outside the first conductive patterns.

22. The chip antenna as set forth in claim 6, wherein the power-feeding terminal and the ground terminal extend from one end of the conductive patterns, are connected parallel to each other, and are formed on one side surface of the base block.

23. The chip antenna as set forth in claim 22, wherein the power-feeding terminal is extended from one end of the conductive patterns toward the upper, lower, and side surfaces of the base block so as to be wound on a part of the base block.

24. The chip antenna as set forth in claim 22, wherein the ground terminal is extended from one end of the conductive patterns toward the upper, lower, and side surfaces of the base block so as to be wound on a part of the base block.

25. The chip antenna as set forth in claim 21, wherein the ground terminal is adjacent to the end of the base block, and the power-feeding terminal is disposed between the conductive patterns and the ground terminal.

26. A chip antenna comprising:

a rectangular parallelepiped base block made of one selected from a dielectric material and a magnetic material;

first conductive patterns including side electrodes wound in a spiral form on a part of the base block, upper and lower electrodes connected to the side electrodes, and ending portions formed on the upper and lower electrodes;

second conductive patterns disposed within the base block between the upper electrodes and the lower electrodes and connected in parallel with the first conductive patterns;

a power-feeding terminal and a ground terminal, both connected to the first conductive patterns;

an impedance-controlling electrode connected to the upper end of the base block between the second conductive patterns and the power-feeding terminal to control the impedance;

an insulating layer formed on the upper surface of the base block; and a parasitic pattern layer including parasitic patterns formed on the insulating layer.

27. A chip antenna comprising:

a base block made of one selected from a dielectric material and a magnetic material and having a multilayered construction by stacking a plurality of sheet layers;

first conductive patterns including side electrodes wound in a spiral form on a part of the base block, upper and lower electrodes connected to the side electrodes, and bending portions formed on the upper and lower electrodes;

second conductive patterns disposed within the base block between the upper electrodes and the lower electrodes and connected in parallel with the first conductive patterns;

a power-feeding terminal and a ground terminal, both connected to the first conductive patterns;

an impedance-controlling electrode connected to the upper end of the base block between the second conductive patterns and the power-feeding terminal to control the impedance; and parasitic patterns formed on at least one sheet layer disposed between the sheet layer provided with the lower electrodes of the first conductive patterns and the sheet layer provided with the upper electrodes of the first conductive patterns, thereby forming an electromagnetic coupling with the first and second conductive patterns.

28. The chip antenna as set forth in claim 27, wherein the parasitic patterns are formed on at least one sheet layer disposed between the sheet layer provided with the upper electrodes of the first conductive patterns and the sheet layer provided with the second conductive patterns.

29. The chip antenna as set forth in claim 27, wherein the parasitic patterns are formed on at least one sheet layer disposed between the sheet layer provided with the lower electrodes of the first conductive patterns and the sheet layer provided with the second conductive patterns.

* * * * *